United States Patent [19]

Schmitkons

[11] Patent Number: 4,601,645

[45] Date of Patent: Jul. 22, 1986

[54] GEAR PUMP-LIQUID GAS MIXER WITH IMPROVED GAS INTRODUCTION

[75] Inventor: James W. Schmitkons, Lorain, Ohio

[73] Assignee: Nordson Corporation, Amherst, Ohio

[21] Appl. No.: 697,853

[22] Filed: Feb. 4, 1985

[51] Int. Cl.[4] ..... F01C 1/18; F01C 11/00; B01F 5/14

[52] U.S. Cl. ..... 418/9; 418/15; 261/28; 261/84; 222/190

[58] Field of Search ..... 418/9, 15; 261/28, 84; 425/4 R, 4 C, 376 B; 264/50; 222/135, 136, 190

[56] References Cited

U.S. PATENT DOCUMENTS 4,193,745 3/1980 Hamilton et al. ..... 418/9
4,264,214 4/1981 Scholl et al. ..... 366/103

FOREIGN PATENT DOCUMENTS 865827 4/1961 United Kingdom ..... 418/15

*Primary Examiner*—John J. Vrablik
*Attorney, Agent, or Firm*—Wood, Herron & Evans

[57] ABSTRACT

A two stage mixing gear pump for dispersing a gas into a liquid wherein a metered quantity of liquid from the first stage of the pump is supplied to gas filled intertooth spaces of the second stage pump. The gas is introduced into the intertooth spaces of the second stage of the pump through a gas inlet which is adjacent the low pressure side of the gear teeth meshing zone of the second stage of the pump and the liquid enters the gas containing intertooth spaces downstream of the gas inlet.

4 Claims, 6 Drawing Figures

GEAR PUMP-LIQUID GAS MIXER WITH IMPROVED GAS INTRODUCTION

This invention relates to gear pumps and more particularly to an improved gear pump for mixing a gas with a liquid to form a solution of the gas in the liquid.

In U.S. Pat. No. 4,193,745 of William M. Hamilton, et al, assigned to the assignee of this application, there is disclosed a two-stage gear pump for dispersing a gas into a liquid and for pumping that gas from the pump outlet as a liquid gas solution. According to the disclosure of this patent, liquid is supplied to the inlet of a first stage of the pump and is metered from that first stage to a liquid inlet of the second stage of the pump. In the second stage of the pump, the metered liquid material is introduced to the pumping chamber through a liquid inlet which is located between the two gears at the point where the gears are just coming out of engagement. Two gas inlets are provided, one for each of the two gear lobes of the second stage pumping chamber. Each gas inlet enters its respective lobe in the second stage pumping chamber at a position spaced downstream (i.e., in the direction of gear rotation) from the liquid inlet and separated from the liquid inlet by one or more gear teeth. According to the disclosure of this patent, the metered flow of liquid is just sufficient to partially fill the space between the gear teeth of the second stage, which empty space is then filled by the gas flow. The liquid and gas received in the spaces between the teeth of the gears is then carried in those spaces around the periphery of the pumping chamber as the gears rotate and is delivered to an outlet at the point where the teeth are again coming into mesh. As the tooth of one gear moves into an intertooth space of the opposite gear, the liquid gas in that space is positively displaced from the space to the second stage outlet and the gas is forced into what is believed to be a true solution in the liquid. The liquid gas solution or mixture, under pump outlet pressure, is then delivered from the outlet of the second stage pumping chamber to a dispenser from which it can be selectively dispensed or released to atmospheric pressure. Upon such release at atmospheric pressure, the gas dispersed in the liquid comes out of the solution to create a foam.

It has been found that the two stage gear pump mixer disclosed in U.S. Pat. No. 4,193,745 is a very effective pump for creating a uniform mixture of liquid gas solution so as to obtain a uniform foam when the liquid gas solution is dispensed at atmospheric pressure. However, this pump is extremely sensitive to manufacturing clearances between the gears and the pumping chamber, and particularly between the sidewalls of the gears of the second stage of the pump. If those clearances are not accurately maintained, the ability of this pump to create foam is very adversely affected. Furthermore, as the pump wears, the ability of the pump to create foam or to disperse gas into the liquid is adversely or detrimentally affected. In other words, if these clearances are not minimized during manufacture of the pump, or as the pump wears, the foaming capacity of the pump is adversely affected.

It has therefore been one objective of this invention to provide a two stage gear pump which is capable of inputting a large quantity of gas into solution with a liquid via a pump which is less sensitive to clearances and manufacturing tolerances than prior art pumps.

Another objective of this invention has been to provide a two stage gear pump which is capable of inputting a large quantity of gas into solution with a liquid via a pump which is less expensive to manufacture than prior art pumps because of the reduction in criticality of manufacturing tolerances required to be held during manufacture of the pump.

These objectives have been achieved and this invention is predicated upon the concept of inputting gas to the intertooth spaces of the gears of the second stage of the gear pump before the metered flow of liquid is supplied to those same intertooth spaces.

In the past, it has been thought and the prior art teaches that if the intertooth spaces are first filled with gas, the compressibility of the gas will result in a "bubble" which will substantially fill the entire intertooth space and resist entry of the liquid into that space. As a consequence, the prior art taught that this would lead to a higher gas/liquid ratio than desired and would result in foam inhomogeneity. I have found though that such is not the case and that, in fact, a more homogeneous gas/liquid foam is created in the pump and the pump is less sensitive to manufacturing or wear clearances if the gas is first introduced into the intertooth spaces of the second stage of the pump before a metered quantity of liquid is admitted to that same space.

According to the practice of this invention, a metered flow of liquid material is supplied from the first stage of a two stage pump to the second stage of the pump. Gas is introduced to the pumping chamber of the second stage of the pump through a gas inlet which is located between the two gears where the teeth are just coming out of engagement as they are rotated by a drive motor. Two liquid inlets are provided, one for each of the two gear lobes of the pumping chamber, downstream from the gas inlet. Each liquid inlet enters its respective lobe in the pumping chamber at a position spaced from the gas inlet and separated from the gas inlet by one or more gear teeth. Consequently, the gas first enters the intertooth space between two gears and then a metered quantity of liquid is inputted to that same space as that space moves past one of the liquid inlets. The gas and liquid are then carried in those spaces around the periphery of the pumping chamber as the gears rotate and delivered to the outlet of the second stage at the point where the teeth are again coming into mesh. As the tooth of one gear moves into an intertooth space of the opposite gear of the second stage of the pump, the liquid gas mixture in that space is positively displaced from the intertooth space to the pump outlet.

Apparently, the reason that this pump is less sensitive to pump clearances and tolerates larger clearances or greater wear without adversely affecting the homogeneity of foam pumped from the pump is that in prior art pumps, such as that disclosed in U.S. Pat. No. 4,193,745, excessive clearance or excessive wear resulted in high pressure liquid squeezing from the high pressure outlet side of the second stage of the pump around the meshed gear teeth to the low pressure or inlet side. As a consequence, the intertooth spaces of the teeth just coming out of mesh was partially filled by this squeeze-by liquid foam solution and then was completely filled by metered flow from the first stage of the pump. That intertooth space then was filled with liquid and liquid gas solution when that space subsequently passed the gas inlet downstream of the liquid inlet. As a result, there was no volume or capacity open for gas when that filled intertooth passed the gas inlet. The result was that either no gas or a minimal quantity of gas was inputted to the intertooth space as the filled space passed the gas inlet and the resulting foam had less than the desired quantity of gas.

The invention of this application, by first inputting the gas before the liquid is inputted to the intertooth space between the second stage gears of the gear pump, eliminates this problem so that if there is any leakage around the meshed gears of the second stage of the pump, that leakage simply displaces liquid rather than gas which enters in the intertooth space. As a consequence, the pump is not nearly so sensitive to clearance or wear in the pump chamber or of the gears of the second stage of the pump, as has been characteristic of prior art two stage gear pumps such as that disclosed in the above-identified U.S. Pat. No. 4,193,745.

These and other objects and advantages of this invention will be more readily apparent from the following description of the drawings in which.

Figure 1:
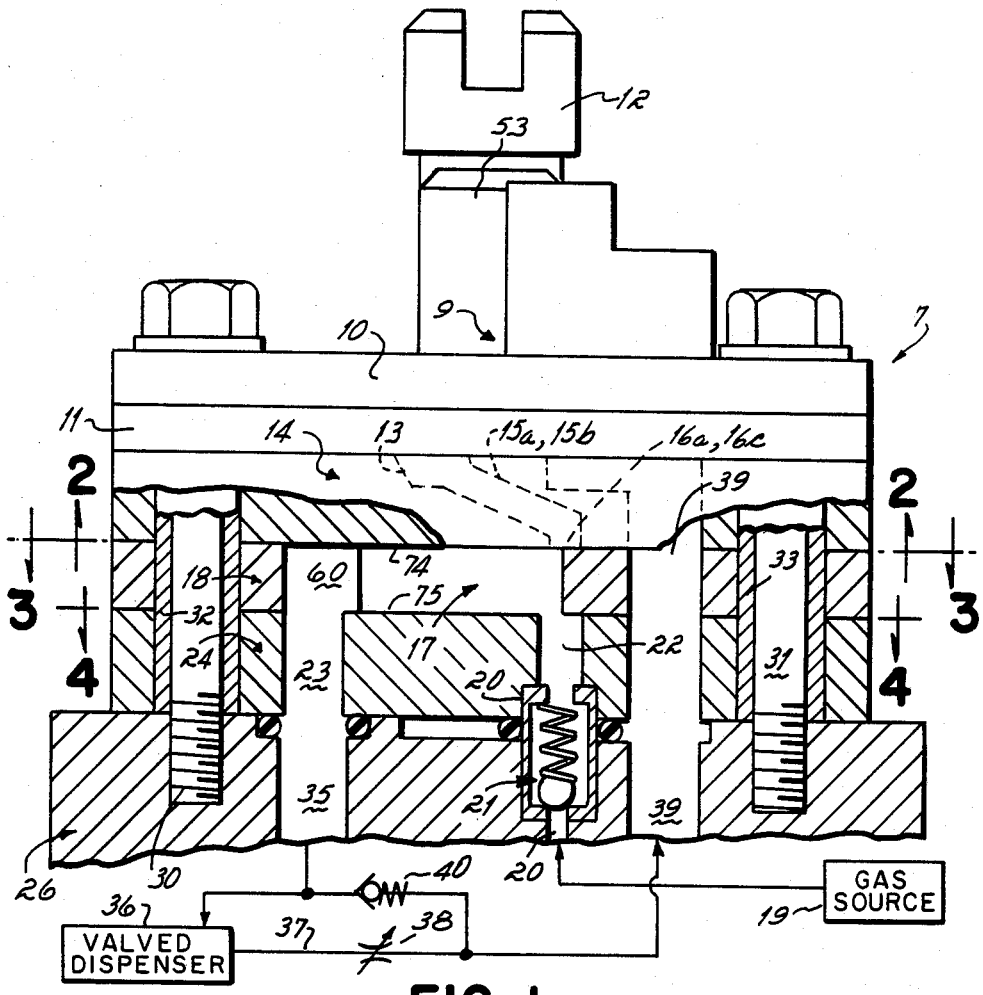
FIG. 1 is a side elevational view, partially broken away, of a two stage gear pump incorporating the invention of this application.
Figure 5:
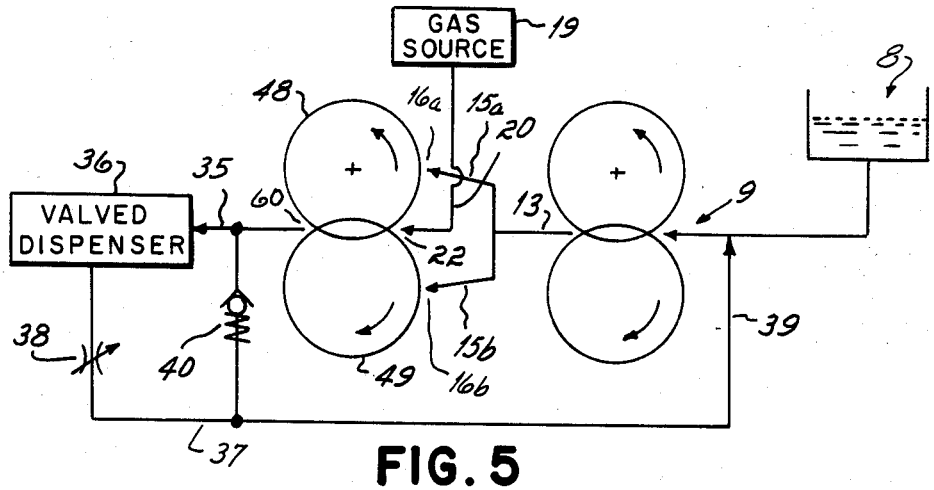
FIG. 5 is a diagrammatic view of a pumping system including the two stage gear pump of this invention.

With particular reference to FIGS. 1 and 5 and by way of brief background description of that overall pump, a feed stream of liquid such as previously melted hot melt adhesive is supplied from a source 8 through an inlet indicated at 9 and flows through an internal passage (not shown) in a first stage inlet plate 10 of a pump body 7 to a first stage gear pump that is housed in a first stage pump plate 11. The first stage pump, as well as the second stage pump to be described, comprises a pair of intermeshed spur gears. One gear of each stage is coupled to and driven by a shaft 12 that is in turn rotated by a motor drive not shown. No gas is mixed with the liquid hot melt in the first stage, in this embodiment. The first stage pump delivers the liquid hot melt to a first stage outlet port indicated by dotted lines at 13, which is formed as a recess on the top side of a first-second stage separator plate 14. From port 13 the liquid material flows through a pair of diagonal bores 15*a*, 15*b* to second stage liquid inlet ports 16*a*, 16*b* all formed in plate 14.

Figure 3:
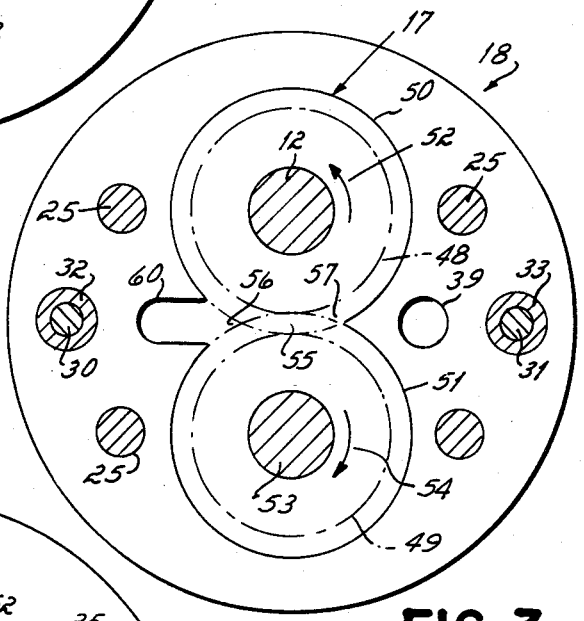
FIG. 3 is a cross sectional view taken on line 3—3 of FIG. 1.
Figure 6:
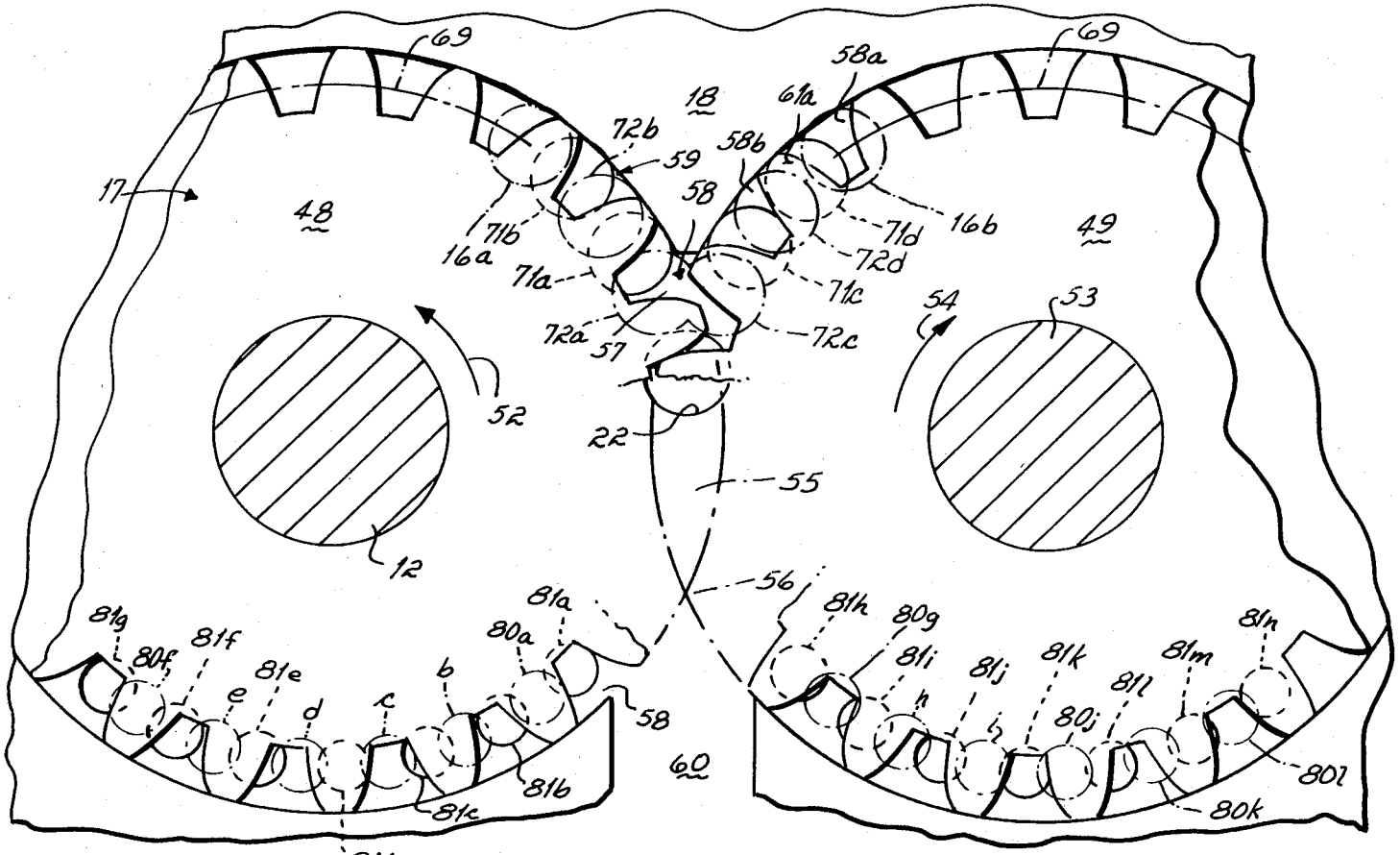
FIG. 6 is an enlarged fragmentary view similar to FIG. 3, showing superimposed the preferred placement of the inlet and the outlet mixing cavities of the pump in relation to the second stage inlet and outlet ports.

As shown in FIG. 3, the second stage pump in this embodiment comprises a pair of gears 48 and 49, which rotate in the respective lobes 50 and 51 of a pumping chamber 17 formed in the second stage pump plate 18. For simplification, the gears have not been shown in the pumping chamber 17 in FIG. 1; they are shown in FIGS. 3 and 6.

In the second stage, liquid adhesive incoming through ports 16*a*, 16*b* is mixed with gas which is delivered to the second stage from a gas source shown diagrammatically at 19, through a passage 20. The gas inlet passage 20 includes a check valve designated generally at 21, which prevents flow of adhesive through passage 20 toward source 19. On the downstream side of check valve 21, a gas inlet passage 22 leads to the pumping chamber 17, as will be described.

In the second stage pump the gas is thoroughly or homogeneously dispersed in the liquid hot melt adhesive, as will be described. The resulting mixture, which is believed to be a true solution, is delivered to a second stage outlet passage 23 that is formed in a second stage outlet plate 24.

Figure 2:
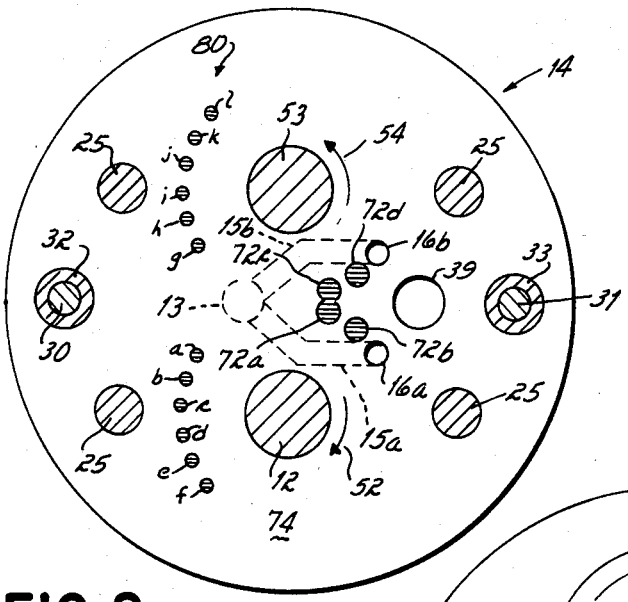
FIG. 2 is a cross sectional view taken on line 2—2 of FIG. 1.
Figure 4:
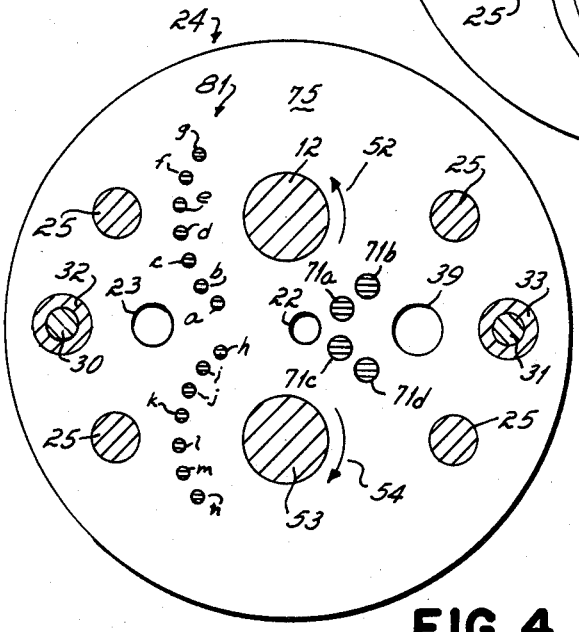
FIG. 4 is a cross sectional view taken on line 4—4 of FIG. 1.

The various plates 10, 11, 14, 18 and 24, referred to above, are aligned in stacked relation by alignment sleeves 32 and 33 (see FIG. 1), and are secured together as a subassembly by bolts 25 (see FIGS. 2–4). The plate subassembly is secured to a manifold block designated generally at 26, by mounting bolts 30, 31, which pass through the plate alignment sleeve 32, 33, respectively.

An outlet passage 35 in manifold 26 leads from the second stage outlet 23 in plate 24, and in use in connected to a valved dispenser 36 which may be a manually or solenoid operated gun of a type known per se. A return or recycle line 37 leads from dispenser 36 through a variable restrictor 38 to a recycle passage 39 in manifold 26. This passage 39 extends through plates 24, 18 and 14, and returns the recycled mixture to the intake of the first stage gears. A relief valve 40, shown diagrammatically in FIGS. 1 and 5, is connected between outlet passage 35 and recycle passage 39 to prevent the system pressure from exceeding a predetermined maximum limit.

In the two-stage gear pump embodiment illustrated in FIGS. 1–6, a mixing means is used in the second stage, in which the gas and liquid hot melt are brought together and mixed. In that stage a pair of gears, shown at 48 and 49 in FIG. 3, rotate within intersecting lobes 50 and 51, respectively, in pump plate 18, that together bound the pumping chamber 17. On the top and at the bottom, chamber 17 is closed by plates 14 and 24, respectively. One of the gears, gear 48, is the drive gear and is keyed to drive shaft 12. In operation, gear 48 is rotated in the direction indicated by the arrow 52. Driven gear 49 is mounted to an idler shaft 53. It meshes with gear 48 in an area 55 designated by dashed lines in FIG. 6, where lobes 50, 51 intersect. Gear 49 is rotated in the direction indicated by arrow 54.

As the gears rotate, their teeth sequentially come into mesh at 56, at one end of the mesh region 55, and come out of mesh at 57 at the opposite end of mesh region 55 (see FIG. 6). Thus, the area adjacent 57 comprises the intake zone, in which the spaces 58 open as the gears come out of mesh on the low pressure side and fill with gas through inlet port 22. As the gears rotate in the direction of arrows 52 and 54 from inlet zone 57, gas in intertooth spaces 58 is transferred around the sides of lobes 50 and 51 through transfer zones 59, to the area at 56. As a tooth of one gear comes into mesh with a space 58 on the opposite gear it progressively displaces gas from that space, and the area 56 thus comprises the outlet zone of the second stage. Zone 56 communicates with a delivery slot 60 formed in pump plate 18, and that slot in turn communicates with outlet passage 23 in second stage outlet plate 24 (see FIGS. 1 and 4).

The liquid hot melt is introduced into the second stage pump from the top side thereof (as viewed in FIG. 1) through ports 16*a*, 16*b*. The gas is introduced somewhat upstream, i.e., in the direction opposite of arrows 52 and 54, from liquid inlet port 16*a*, 16*b*. Specifically, the liquid hot melt is introduced to the pumping chamber lobes 50 and 51 through liquid ports 16*a* and 16*b* respectively. These ports are holes formed in the bottom surface 74 of plate 14 (see FIG. 2). Each of them is fed from the first stage outlet 13 through a separate branch passage 15*a*, 15*b* in plate 14 (see also FIG. 5).

The preferred positioning of liquid inlet ports 16*a* and 16*b* in relation to the paths traversed by the teeth of the respective gears 48 and 49, is shown in enlarged detail in FIG. 6. Each port is preferably spaced downstream (i.e. in the direction of arrows 52 and 54) from gas inlet port 22 by approximately the spacing between two gear teeth.

The ports 16*a* and 16*b* are preferably centered approximately on the pitch circle 69 of gears 48 and 49, and their radially outer edges lie approximately on the circumference of the lobes 50 and 51 (see FIG. 6). The diameter of each port 16*a*, 16*b* is greater than the width of a single tooth, as measured on the pitch circle. By way of specific example, for a 16 diametral pitch gear having 20 teeth and a pitch diameter of 1.250", the diameter of ports 16*a* and 16*b* is preferably about 0.140". While the relative diameter and positioning described for these ports 16*a* and 16*b* is not critical in respect to gear size, they do represent the preferred embodiment. As previously noted, ports 16*a* and 16*b* are spaced downstream of gas inlet 22 by about the spacing between the centers of two gear teeth, so that two teeth always lie between the gas and liquid inlets.

Between the liquid inlet ports 16*a* and 16*b* and the gas inlet port 22, a plurality of mixing means are formed. These mixing means are a plurality of blind cavities 71 and 72 positioned in staggered or diagonally offset relation on the surfaces 75 and 74 of plates 24 and 14 which bound the bottom and top of the pumping chamber (see FIG. 1). Preferably all of these cavities 71 and 72 are of the same diameter as gas inlet ports 16*a* and 16*b*, and all lie on the pitch circle 69. In other words, they are of the same size and radial position as the ports 16*a* and 16*b*. However, unlike ports 16*a* and 16*b*, they are blind cavities. They are not connected to any passage in the plates.

Preferably there are at least two mixing cavities (which can be on opposite surfaces 74 and 75 to balance their effect) between gas inlet port 22 and the liquid inlet ports. In the embodiment shown in FIG. 4, four mixing cavities 71*a*, 71*b*, 71*c* and 71*d* are formed in face 75 of plate 24, two cavities opening into each lobe 50 and 51. Four cavities 72*a*, 72*b*, 72*c* and 72*d* are also formed in face 74 of plate 14, two opening to each lobe 50, 51.

The included angle between adjacent cavities on the same plate is less than the included angle between adjacent gear teeth, and preferably is about 2 degrees less. The cavities 72 in plate 14 are at circumferential positions that are midway between the centers of cavities 71 on plate 24; that is, the opposite cavities are staggered, as can best be seen in FIG. 6. Cavities 72*a* and 72*c*, closest the gas inlet 22, intersect one another in plate 14, and are offset by about half their diameter from gas inlet port 22 in plate 24 (see FIGS. 1 and 6). In FIG. 2 it will be noted that the spacing between a liquid inlet port 16*a* or 16*b* and the adjacent cavity 72*b* or 72*d* is about the same as that between each cavity and the next cavity 72*a* and 72*c*. The cavities can be formed by drilling and may be about 0.030" deep.

The provision of the mixing cavities 71 and 72 is effective in uniformly mixing the gas into the liquid. The cavities are "blind", that is they lead nowhere, and nothing is introduced through them. Each intertooth space 58 picks up a measured volume of gas as it sweeps past the gas inlet port 22. The intertooth space 58 then partially fills with liquid as the space passes the liquid inlet ports 16*a*, 16*b*, but since the second stage pump has a displacement which is greater than the volume of liquid delivered to it by the first stage, some gas is accommodated in each intertooth space. The liquid introduced via ports 16*a* and 16*b* is under pressure, which is sufficiently high to overcome the gas pressure in the intertooth space as the space passes liquid inlet ports 16*a*, 16*b*.

Since the mixing cavities 71 and 72 are wider than the gear teeth, each tooth is "straddled" by a cavity as the tooth passes across it; the cavity provides a short circuit path across the tooth (from its leading side to its trailing side) through which the liquid pressure is reflected back (upstream) across the tooth to the next following space. This "pressure pulse" or surge tends to increase the motion of the liquid relative to the gas in each space 58, and thereby improves mixing. More specifically, referring to FIG. 6, liquid introduced through liquid inlet port 16*b* into the intertooth space 58*a* can expand and flow into mixing cavity 71*d* and as the gear tooth 61*a* wipes across cavity 71*d*, the liquid pressure in that cavity is reflected across the tooth to the next intertooth space 58*b*, into the opposite cavity 72*d*, and so on. Thus the liquid "bleeds back," i.e., upstream from the direction of gear rotation, toward gas inlet 22. This motion and pressure cycling causes turbulence which improves mixing of the liquid and gas within the respective tooth spaces.

It is to be noted that inlet mixing cavities 71 and 72 need not extend very far in the downstream direction from the gas inlet port 22, or beyond the positions of the liquid gas inlet ports 16*a* and 16*b*. Their precise location, shape, number and diameter is not, in fact, particularly critical. In general, the mixing cavities should be positioned to provide irregular communication (as the teeth pass in rotation) with the intertooth spaces.

The mixing cavities just described can be referred to as inlet mixing means, since the cavities are adjacent the gas and liquid inlet ports. Alternatively, and preferably in addition to the inlet mixing means, a separate set of mixing cavities is also provided, closer to and upstream of the outlet zone 56 of the second stage pump. These can be referred to as the outlet mixing means. As are the inlet mixing means, the outlet mixing means are preferably in the form of blind cavities in surfaces 74 and 75 of plates 14 and 24, respectively; but they are upstream of delivery slot 60.

In the embodiment shown, several outlet mixing cavities, each designated by 80, are formed in plate 14 on each side of the outlet zone 56 (see FIGS. 2 and 6). In plate 24, on the lower side of the second stage gears, several additional cavities are formed on each side of zone 56, these each being designated at 81 (see FIGS. 4 and 6). As are the inlet mixing cavities, the several cavities 80 and 81 are blind, they may be quite shallow, and do not lead through the plates to any passage. Preferably, although not critically, they may be smaller than the inlet cavities; referring to the pump of the dimensional example given above, the outlet cavities may be drill holes 0.030" deep and 0.086" diameter, in comparison to the 0.030" depth and 0.140" diameter of the inlet cavities. The centers of the cavities 80 and 81 may lie on or near the pitch circle of gear 48 and 49, such that the radially inner edge of the cavities is approximately at the same radial distance as the roots of intertooth spaces. Whereas the inlet mixing cavities may have diameters greater than the width of the gear teeth, to permit liquid bleed back toward the inlet, the outlet mixing cavities 80 and 81 have diameters smaller than the width of the gear teeth, so that no cavity will "straddle" or project beyond the width of the gear tooth as the tooth passes over it. That is, the width of a gear tooth, where it passes over an outlet cavity, is greater than the diameter of the cavity. This is to prevent outlet pressure from short circuiting across the gear tooth. The cavities in the plates 14 and 24 are preferably staggered, as is apparent in FIG. 6. By way of example, for use with a pump having 20-tooth gears, 16 diametrical pitch with a pitch diameter of 1.250", the centers of opposite cavities 80 and 81 may be about 7° apart, as measured from the center of the gear, so that spacing between adjacent cavities on the same plate is slightly less than the 18° spacing between adjacent gear teeth. The downstreammost outlet cavity (81*a* and 81*n* in FIG. 6) may be at a 45° angle from an imaginary line connecting the gear centers; and the arc between them and upstreammost outlet cavities may suitably be about 90°.

In operation, as the moving gear teeth seal and unseal the outlet mixing cavities, the gas in the respective intertooth spaces apparently expands or moves toward the cavity. This pulse creates turbulence and fluid movement within the space and thereby promotes better mixing.

It is to be noted that in this pump, as compared to the pump disclosed in the above-identified U.S. Pat. No. 4,193,745, the gas and liquid inlets are reversed. That is, where the liquid had previously been introduced in the area of the port 22 in the prior art and the gas in the area of the ports 16*a*, 16*b*, that relationship has been reversed in this application. The advantage of this reversal is that the resulting pump is no longer required to have very tight or minimal clearances between the second stage gears 48, 49 and the second stage pumping chamber 17 in order to obtain high ratio gas to liquid content foam or to maintain homogeneity of the foam product. I have theorized, although I do not wish to be limited to the theory, that the reason that the prior art pumps, such as the pump disclosed in the above-identified U.S. Pat. No. 4,193,745, is so sensitive to tight clearances between the gears and the pumping chamber 17 is that in the absence of such tight or minimal clearances, high pressure liquid/gas solution leaks from the high pressure side of the intermeshing tooth zone 55 to the low pressure zone to partially fill the intertooth space 58 with that solution before a metered quantity of liquid is introduced to the intertooth space from the first stage pump. When that metered quantity of liquid is added to the leakage liquid/gas solution, I theorize that the intertooth space is filled or very nearly filled when it subsequently passes the gas inlet ports, with the result that little or no gas can then be introduced because there is no space available to receive the gas. This explains why, as the pump wears and the clearances increase, the pump becomes less effective as a device for mixing gas into liquid and the resulting foam contains lesser quantities of gas or becomes less homogeneous.

The invention of this application overcomes this sensitivity to clearances between the gears 48, 49 and the pumping chamber 17 by introducing the gas through the inlet port 22 before the metered liquid from the first stage pump is subsequently added to the intertooth space. As a consequence, even in a well worn pump or a pump which has relatively large clearance between the gears and the pumping chamber 17, the pump continues to function properly and to produce good homogeneous foam having a proper and consistent gas to liquid ratio in the output product. The pump of this invention is therefore much less subject to clearance sensitivity or to becoming useless because of excessive clearances resulting from wear than prior art pumps.

While I have described only a single preferred embodiment of my invention, persons skilled in this art will appreciate changes and modifications which may be made without departing from the spirit of my invention. Therefore, I do not intend to be limited, except by the scope of the following appended claims.

I claim:

1. A two stage gear pump wherein liquid is introduced into a first stage of the pump, metered from the first stage of the pump into the second stage of the pump, intermixed with a gas in the second stage of the pump, and delivered as a mixture to the pump outlet, each of said first and second stages of said pump having a pumping chamber, a pair of meshing gears rotatably mounted in said pumping chamber, gear teeth on said gears interengaged in a meshing zone of said chamber, and an inlet port adjacent one end of said meshing zone and an outlet port adjacent the other end of said meshing zone, means for supplying liquid to said inlet port of said first stage pump, means for transporting a metered flow of liquid from said first stage pump outlet to said second stage of said pump, means for supplying gas to said second stage of said pump, and the improvement wherein said gas is supplied to said inlet port of said second stage pump and the means for transporting a metered flow of liquid from said first stage of said pump to said second stage of said pump delivers said liquid to a pair of liquid inlet ports spaced downstream from said gas inlet port.

2. The pump of claim 1 which further includes a drive shaft for driving the gears of said first and second stages of said pump, said drive shaft being adapted to be connected to a drive motor.

3. A two stage gear pump wherein a gas and a liquid are separately introduced, intermixed, and delivered as a mixture to a pump outlet, said pump comprising, a pump body having a first stage pumping chamber, first stage intermeshing gears mounted for rotation in said first stage pumping chamber, said first stage gears having gear teeth which interengage in a first stage meshing zone of said first stage pumping chamber, a first stage liquid inlet entering said first stage pumping chamber adjacent a first end of said first stage meshing zone, a first stage liquid outlet communicating with said first stage chamber adjacent a second end of said first stage meshing zone, a second stage gear chamber in said pump body, second stage intermeshing gears mounted for rotation in said second stage pumping chamber, said second stage gears having teeth which interengage in a second stage meshing zone of said second stage pumping chamber, a gas inlet entering said second stage pumping chamber adjacent a first end of said second stage meshing zone, a pair of second stage liquid inlets entering said second stage pumping chamber at a position spaced downstream from said gas inlet, conduit means connecting said first stage liquid outlet to said pair of second stage liquid inlets, and a second stage outlet communicating with said second stage pumping chamber adjacent a second end of said second stage meshing zone, said second stage outlet being in communication with said pump outlet for delivering a mixture of liquid and gas to said pump outlet.

4. The pump of claim 3 which further includes a drive shaft for driving said first and second stage gears in rotation, said drive shaft being adapted to be connected to a drive motor.

* * * * *